United States Patent [19]

Gierek et al.

[11] 4,070,511

[45] Jan. 24, 1978

[54] METHOD OF PRODUCING LAYERS OF LEAD AND ITS ALLOYS ON WORKPIECES MADE OF FERROUS ALLOYS

[75] Inventors: Adam Gierek; Lech Bajka, both of Katowice; Piotr Liberski, Poreba; Anna Gruszecka, Katowice, all of Poland

[73] Assignee: Politechnika Salaska Im. Wicentego Pstrowskiego, Gliwice, Poland

[21] Appl. No.: 713,219

[22] Filed: Aug. 9, 1976

[30] Foreign Application Priority Data

Aug. 15, 1975 Poland ..... 182775

[51] Int. Cl.[2] ..... C23C 1/06; C23C 1/08

[52] U.S. Cl. ..... 427/405; 427/431; 427/433; 428/645; 428/653; 428/643; 428/644

[58] Field of Search ..... 427/431, 433, 405, 432; 29/196.2; 308/237 R, 237 A, 241; 118/403, 402; 428/645, 653, 643, 644

[56] References Cited

U.S. PATENT DOCUMENTS

| | | | |
|---|---|---|---|
| 1,151,629 | 8/1915 | Turnbull | 118/403 |
| 2,428,523 | 10/1947 | Marshall | 427/433 X |
| 2,615,768 | 10/1952 | Schluchter | 427/433 X |

*Primary Examiner*—Ralph S. Kendall

*Attorney, Agent, or Firm*—Haseltine, Lake & Waters

[57] ABSTRACT

A method of producing layers of lead and its alloys on workpieces made of ferrous alloys comprising dipping the workpieces to be coated into a two-layer bath, the upper layer of which is a bath of aluminum or its alloys, and the bottom layer of which is a bath of lead or its alloys. The workpieces are then taken out of the deeper layer of the bath of lead and its alloys by pulling them through the upper layer of the bath of aluminum and its alloys, or by pulling the workpieces through the bath of metal, provided in a vessel connected with the bottom layer of the bath.

The temperature of both baths, the upper bath and of the bath in the vessel connected with the bottom bath, is maintained within the range of 150° C to 900° C. The temperatures of the bath of the upper layer, of the bath of the bottom layer, and of the bath in the vessel connected with the bath of the bottom layer are equal or differ from each other by 50° C to 750° C.

14 Claims, No Drawings

METHOD OF PRODUCING LAYERS OF LEAD AND ITS ALLOYS ON WORKPIECES MADE OF FERROUS ALLOYS

This invention relates to a method of producing layers of lead and its alloys on workpieces made of ferrous alloys.

Hitherto, the surfaces of products made of ferrous alloys are protected against corrosion in environments containing aggressive compounds of sulphur, mainly $H_2S$, $CS_2$, $H_2SO_4$, by dipping the workpieces, previously galvanized, in a bath of lead alloys, mainly with tin and antimony, by electrolytic depositing of lead on the surface of said products, as well as by surfacing the previously tinned workpieces with layers of lead or its alloys.

The known method of lead plating involves many inconveniences associated with the production process of applying lead surfaces, and with the quality and utility properties of the produced layers.

One of the known methods of depositing layers of molten lead onto the workpieces made of ferrous alloys requires the workpieces to be previously tinned. Such prepared surface is formed in a gas flame with a layer of lead. This process does not secure the continuity and uniformity of the coating, as well as the uniform thickness thereof. Moreover, it is noxious for the servicing personnel. It does not also permit performing the heat treatment in the course of lead plating, for improving the mechanical properties of the coated products.

Numerous inconveniences are involved also in the process of electrolytic lead plating. It is very time consuming and requires complex equipment to be used, whereby the deposited layers of lead form adhesion coatings with inappreciable thickness. They easily undergo defoliation and cissing. The process of electrolytic lead plating does not permit conducting the heat treatment together with forming the coating which can improve the mechanical properties of the coated products.

The object of the invention consists in obtaining, in a hot-dip process, a diffusion coating of lead or its alloys concurrently with heat treatment of the coated products, for improving the mechanical properties thereof.

The method according to the invention comprises dipping the workpieces to be coated into a two-layer bath, the upper layer of which is a bath of aluminum or its alloys, the bottom layer of which is a bath of lead or its alloys.

The workpieces are dipped into the two-layer bath with a two-stage movement, the rate of dipping into the upper layer of the bath is maintained within the range of 1 to 10 m/min, whereafter the workpieces are held in this zone for a time period of up to 60 minutes, and the rate of displacing from the upper layer into the bottom layer is maintained within the range of 0.1 to 10 m/min, the workpieces being held in the bath of the bottom layer for a time of up to 60 minutes. The temperature of both baths, as well as of the bath in a vessel connected with the bottom bath is maintained within the range of 150° - 900° C, the temperatures of the bath of the upper layer, of the bath of the bottom layer, and of the bath in the vessel connected with the bath of the bottom layer are equal, or differ by 50° - 750° C.

The workpieces are taken out of the bottom layer of the bath of lead and its alloys by drawing them through the upper layer of the bath of aluminum and its alloys, or by pulling them through the metal bath in the vessel connected with the bottom layer of the bath.

The workpieces are taken out from the bottom layer of the bath of molten lead or its alloys with a continuous movement through the upper layer of the bath of aluminum or its alloys at a rate of 1 to 20 m/min, or they are taken out of the bottom layer of the bath of molten lead or its alloys through the bath in the vessel connected with the bottom layer of the bath at a rate of 1 to 20 m/min. The obtained coating is a two-layer coating, and consists of an outer layer of lead or its alloys, and of an inner layer formed of aluminum alloys, separating the outer layer from the base made of ferrous alloy.

The coating is characterized by a uniform thickness and tightness, and since it is a diffusion layer it has good adherence over the whole surface of the lead plated product. The method according to the invention enables easily control both of the structure and the thickness of the deposited coatings, the thickness reaching several millimeters. Said method makes it possible to coat with lead and its alloys workpieces with a deliberately complicated configuration of their surface, and among them also fine products, and makes the products corrosion resistant, especially in environments containing compounds/of sulphur, such as $H_2S$ of $CS_2$.

The method of producing diffusion layers of lead and its alloys on products and parts made of ferrous alloys, according to the invention, is relatively simple and does not require complicated equipment. The effect is obtaining two-layer protective coating, closely adhering to the base, having uniform thickness over the whole surface of the product, and tight, the outer layer of which, exposed to the environment is made of lead or its alloys. It provides, protection against corrosion in numerous media, as for instance, occuring in the chemical industry, especially in media containing compounds of sulphur.

An additional protection of the base in the case of non-tightness of the lead layer is provided by the layer of aluminum alloys, separating the lead layer from the base and having equally good anticorrosion properties.

The wide range of operating conditions of the new technique admits the simultaneous forming of the coating and of heat treatment processes of the lead plated products. Said heat treatment does not require additional quantities of heat or the use of protective atmospheres.

The method according to the invention provides a process which is not time-consuming and is safe for the servicing personnel.

EXAMPLE I

A metal bath in a crucible furnace consists of two mutually not mixable layers, i.e. an upper layer of pure aluminum and a bottom layer of pure lead. Both layers have a temperature of 800° C. A workpiece made of ferritic-pearlitic steel with a content of about 0.3% C, previously superficially cleaned, is dipped into the upper layer at a rate of 5 m/min, and is held thereat for 5 minutes. After this time it is dipped into the lower layer at a rate of 5 m/min, and is held there for 10 minutes. After taking out the workpieces from the bath at a uniform rate of 10 m/min, they are cooled in the air.

EXAMPLE II

The metal bath is provided in a two-crucible furnace, a crucibles being connected at in their bottom parts with a channel. One of the crucibles is filled with a two-layer bath consisting of the upper layer of molten aluminum and a bottom layer of molten lead. The temperature of the two-layer bath is 850° C. The other crucible is filled with a bath of a single-layer molten alloy of 38% Pb and 62% Sn, having a temperature of 200° C. A workpiece made of grey cast iron in pearlitic matrix, after previous preparing the surface, is dipped into the upper aluminum layer of the bath at a rate of 5 m/min and held there for 10 minutes. Then, at a rate of 2 m/min it is dipped deeper into the bottom layer of the two-layer bath, and is held there also for 10 minutes. After this time the workpiece is pulled at, a rate of 15 m/min, through the channel into the single-layer bath of the Pb-Sn alloy having a temperature of 200° C, and then, at the same rate, it is brought to the surface. After removal the workpiece is cooled in the air.

What is claimed is:

1. A method of producing a corrosion-resistant, diffusion layer of lead or its alloys on a workpiece made of a ferrous alloy, said method comprising dipping the workpiece to be coated into a two-layer bath, the upper layer of which is a bath of aluminum of its alloys, and the lower layer of which is a bath of lead or its alloys, the workpiece passing first through the upper layer to form an aluminum coating thereon and then through the lower layer to form a diffusion lead layer of uniform thickness and corrosion-resistant properties.

2. A method as claimed in claim 1 wherein said workpiece is removed from the lower layer by upwardly passing the same through the upper layer.

3. A method as claimed in claim 1 wherein said workpiece is removed from the lower layer by passing the workpiece through a third bath, separate and distinct from said second bath.

4. A method as claimed in claim 3 wherein the third bath is a lead-tin alloy.

5. A method as claimed in claim 4 wherein said second and third baths are at different temperatures.

6. A method as claimed in claim 5 wherein said first and second bath are at a temperature of 800° C and said third bath is at a temperature of 200° C.

7. A method as claimed in claim 6 wherein said second and third baths are at different temperatures.

8. A method as claimed in claim 7 wherein said first and second bath are at a temperature of 800° C and said third bath is at a temperature of 200° C.

9. A method as claimed in claim 1 wherein the temperature of/the baths is above the melting point thereof and between 150° C and 900° C.

10. A method as claimed in claim 1 wherein the temperature of the layers are equal or differ by 50° to 750° C.

11. A method as claimed in claim 1 wherein said workpiece is dipped in the upper layer at a rate of 1–10 m/min and held in the upper layer for a time up to 60 min. whereafter the workpiece is dipped into the lower layer at a rate of 0.1–10 m/min. and held therein for a time up to 60 min.

12. A method as claimed in claim 11 wherein the workpiece is removed from the lower layer by upwardly passing the workpiece through the upper layer at a rate of 1–20 m/min.

13. A method as claimed in claim 11 wherein the workpiece is removed from the lower layer by passing the workpiece through a third bath separate and distinct from said second bath.

14. A method as claimed in claim 13 wherein the third bath is a lead-tin alloy.

* * * * *